US011769960B2

(12) United States Patent
Masuda

(10) Patent No.: US 11,769,960 B2
(45) Date of Patent: Sep. 26, 2023

(54) CONNECTOR WITH IMPROVED TERMINAL LOCKING DEVICE

(71) Applicant: Yazaki Corporation, Tokyo (JP)

(72) Inventor: Satoki Masuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 84 days.

(21) Appl. No.: 17/389,947

(22) Filed: Jul. 30, 2021

(65) Prior Publication Data

US 2022/0052473 A1 Feb. 17, 2022

(30) Foreign Application Priority Data

Aug. 13, 2020 (JP) ..... 2020-136543

(51) Int. Cl.
*H01R 13/436* (2006.01)
*H01R 13/502* (2006.01)
*H01R 13/52* (2006.01)

(52) U.S. Cl.
CPC ..... *H01R 13/4365* (2013.01); *H01R 13/502* (2013.01); *H01R 13/5202* (2013.01)

(58) Field of Classification Search
CPC ..... H01R 13/4365; H01R 13/502; H01R 13/5202; H01R 13/506; H01R 13/748; H01R 13/4362; H01R 2105/00; H01R 13/42; H01R 13/46
See application file for complete search history.

(56) References Cited

U.S. PATENT DOCUMENTS 9,281,627 B2 * 3/2016 Fujiwara ..... H01R 13/6581
11,456,560 B2 * 9/2022 Masuda ..... H01R 13/5202
2009/0111318 A1 4/2009 Horiuchi et al.
2012/0021632 A1 * 1/2012 Matsumoto ..... H01R 13/5208 439/271
2013/0017719 A1 * 1/2013 Tanaka ..... H01R 13/521 439/587
2013/0078872 A1 3/2013 Tashiro
2014/0038459 A1 * 2/2014 Kobayashi ..... H01R 13/65912 439/607.41
2014/0370753 A1 * 12/2014 Kobayashi ..... H01R 13/5216 439/607.41
2016/0134049 A1 * 5/2016 Kataoka ..... H01R 13/6581 439/587
2016/0172784 A1 * 6/2016 Kataoka ..... H01R 13/5219 439/271
2019/0237899 A1 8/2019 Makino
2022/0052473 A1 * 2/2022 Masuda ..... H01R 13/506

FOREIGN PATENT DOCUMENTS

JP 2017-157417 A 9/2017

* cited by examiner

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

Included are terminal metal parts mounted on ends of electric wires, a housing housing the terminal metal parts at a housing completion position thereinside and to be inserted and fit into a counterpart fitting portion headed by a tip, a terminal locking member mounted on the housing from outside along a direction crossing an insertion direction of the housing to the counterpart fitting portion and locking the terminal metal parts as they are at the housing completion position at a mounting completion position with respect to the housing, and a front holder causing the housing to be inserted headed by the tip and locking the terminal locking member at the mounting completion position.

3 Claims, 10 Drawing Sheets

CONNECTOR WITH IMPROVED TERMINAL LOCKING DEVICE

CROSS-REFERENCE TO RELATED APPLICATION(S)

The present application claims priority to and incorporates by reference the entire contents of Japanese Patent Application No. 2020-136543 filed in Japan on Aug. 13, 2020.

BACKGROUND OF THE INVENTION

1. Field of the Invention

The present invention relates to a connector.

2. Description of the Related Art

In conventional connectors, a terminal metal part is housed inside a housing, and the terminal metal part is kept at a housing completion position by a terminal locking mechanism inside the housing. The terminal locking mechanism includes a terminal locking body cantilevered and elastically deformable formed in the housing, or what is called a lance, and a through hole formed in the terminal metal part, for example, and a locking protrusion of the terminal locking body is inserted into the through hole of the terminal metal part at the housing completion position, thereby locking the terminal metal part at the housing completion position. Japanese Patent Application Laid-open No. 2017-157417 discloses a connector provided with a terminal locking mechanism of this kind.

In the conventional terminal locking mechanism, the terminal locking body becomes elastically deformed while being pushed by the terminal metal part having been inserted into the housing, and when the terminal metal part has been inserted to the housing completion position, the terminal locking body causes the locking protrusion to be inserted into the through hole while relaxing the elastic deformation. Thus, in the conventional connector, the housing is required to be provided with at least a space for the terminal locking body to be present inside the housing with the locking protrusion inserted into the through hole and a retracting space for the terminal locking body for the terminal locking body to become elastically deformed. Consequently, the conventional connector has a limitation in a reduction in size so long as such a terminal locking mechanism is involved.

SUMMARY OF THE INVENTION

Given these circumstances, an object of the present invention is to provide a connector capable of keeping a terminal metal part at a housing completion position while achieving a reduction in size.

In order to achieve the above mentioned object, a connector according to one aspect of the present invention includes a terminal metal part mounted on an end of an electric wire; a housing housing the terminal metal part at a housing completion position inside the housing and to be inserted and fit into a counterpart fitting portion headed by a tip; a terminal locking member mounted on the housing from outside along a direction crossing an insertion direction of the housing to the counterpart fitting portion and locking the terminal metal part as the terminal metal part is at the housing completion position at a mounting completion position with respect to the housing; and a front holder causing the housing to be inserted headed by the tip and locking the terminal locking member at the mounting completion position.

According to another aspect of the present invention, in the connector, it is possible to configure that the housing has a fitting part housing the terminal metal part inside the fitting part and to be inserted and fit into the counterpart fitting portion having an inner circumferential wall face and a protruding part at the tip protruding toward the insertion direction side from an end face of the fitting part on the insertion direction side, housing the terminal metal part inside the protruding part, and mounted with the terminal locking member, and the front holder has a first tube part causing the fitting part to be inserted and a second tube part causing the protruding part to be inserted together with the terminal locking member.

According to still another aspect of the present invention, in the connector, it is possible to further include that a ring-shaped water stop member having an inner circumferential face side fit to a protruding portion of an outer circumferential wall face of the fitting part from the front holder to fill a ring-shaped gap between the protruding portion of the outer circumferential wall face and the inner circumferential wall face of the counterpart fitting portion, wherein the front holder locks the water stop member at a fitting completion position with respect to the fitting part.

According to still another aspect of the present invention, in the connector, it is possible to further include that the water stop member has a locked part protruding inward from the inner circumferential face, the fitting part has a locking part causing the locked part to be inserted and locking the locked part, and one of the fitting part and the front holder has a viewing window part communicating with the locking part and enabling the locked part inserted into the locking part to be visually checked from outside with the front holder mounted on the fitting part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment of a connector according to the present invention in detail based on the accompanying drawings. This embodiment does not limit this invention.

Embodiment

The following describes an embodiment of the connector according to the present invention based on FIG. 1 to FIG. 10.

Figure 1:
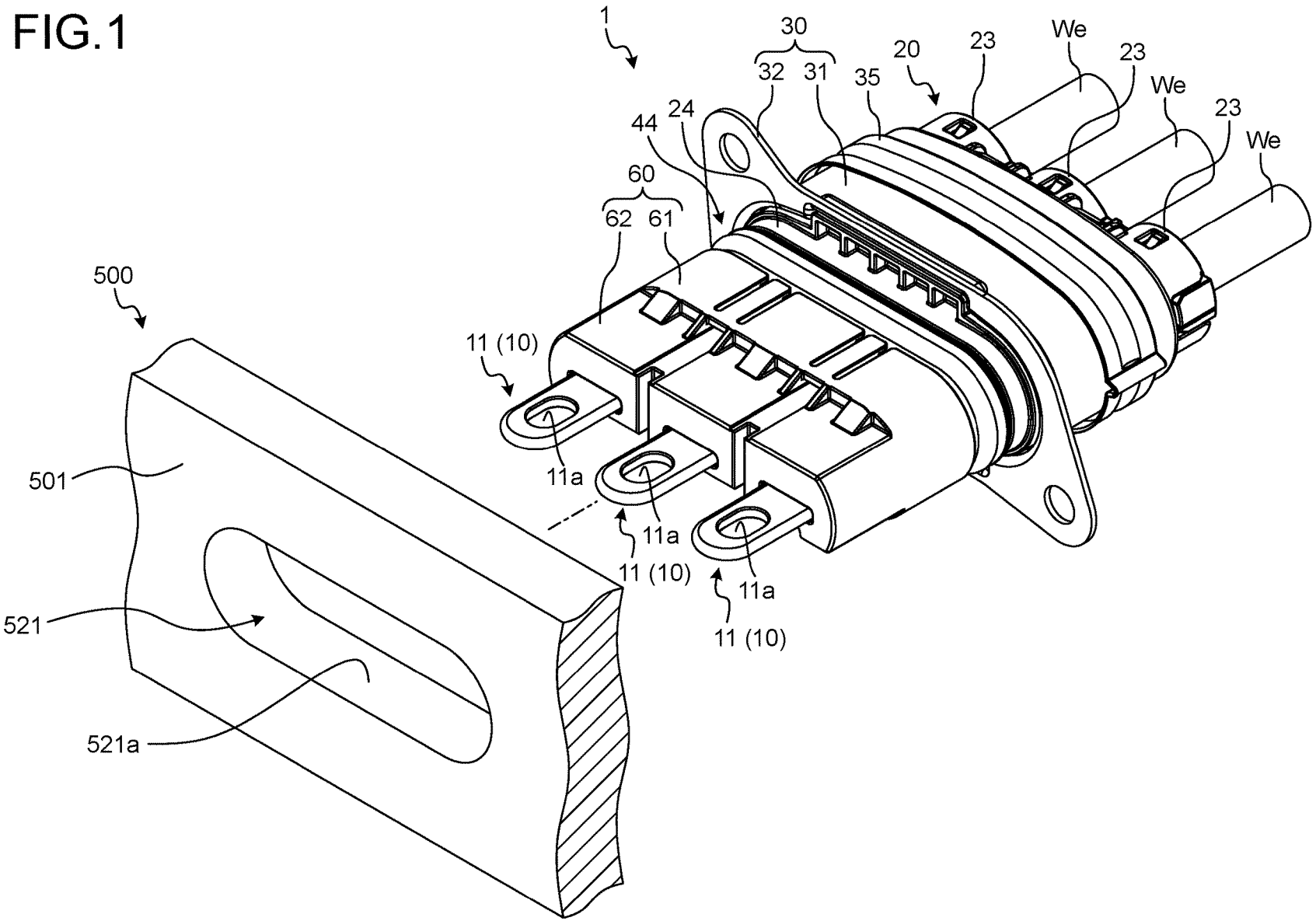
FIG. 1 is a perspective view of a connector of an embodiment.

The symbol 1 in FIG. 1 to FIG. 8 indicates the connector of the present embodiment. This connector 1 is inserted and fit into a counterpart fitting portion 521 headed by a tip to be electrically connected to counterpart terminal metal parts (not illustrated) (FIG. 1). The connector 1 illustrated herein is configured to be inserted and fit into the hole-shaped counterpart fitting portion 521 having an inner circumferential wall face 521*a*, for example. This connector 1 is inserted into and removed from the hole-shaped counterpart fitting portion 521 along a hole axial direction of this counterpart fitting portion 521. The counterpart fitting portion 521 is formed such that its section orthogonal to the hole axial direction is circular-shaped or oval-shaped, for example. The counterpart fitting portion 521 may be formed in a tubular shape, with a fitting part 21 inserted and fit into its inside space.

The connector 1 is electrically connected to the counterpart terminal metal parts of a counterpart device 500 to electrically connect this counterpart device 500 and a device (not illustrated) led by electric wires We to each other, for example (FIG. 1). The counterpart device 500 includes a metallic housing 501, in which a through hole formed in a wall body of this housing 501 is used as the counterpart fitting portion 521. This counterpart device 500 includes a terminal block or a counterpart connector (not illustrated) inside the housing 501. The counterpart terminal metal parts are included in the terminal block or the counterpart connector. Thus, the connector 1 is inserted and fit into the counterpart fitting portion 521 to be electrically connected to the counterpart terminal metal parts of the terminal block or the counterpart connector inside the housing 501.

In the following, when an insertion direction is referred to simply without any special reference, the insertion direction indicates an insertion direction of the connector 1 into the counterpart fitting portion 521. When a removal direction is referred to simply without any special reference, the removal direction indicates a removal direction of the connector 1 from the counterpart fitting portion 521. When an insertion-and-removal direction is referred to simply without any special reference, the insertion-and-removal direction indicates an insertion-and-removal direction of the connector 1 into and from the counterpart fitting portion 521.

This connector 1 includes terminal metal parts 10, a housing 20, and a shield shell 30 (FIG. 1 to FIG. 8).

Figure 3:
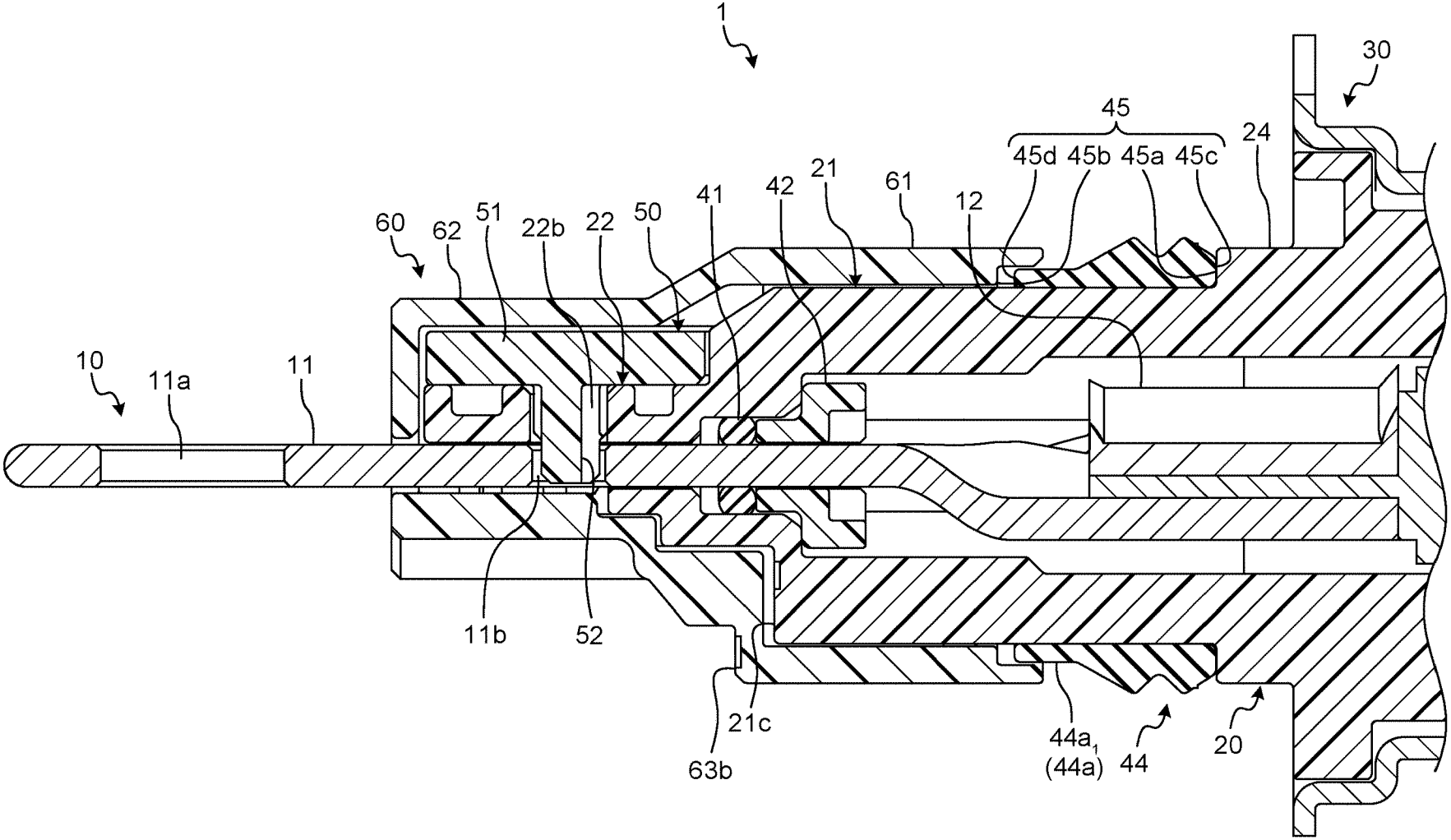
FIG. 3 is an X1-X1 line sectional view of FIG. 2, representing that a terminal locking member is at a full locked position.
Figure 5:
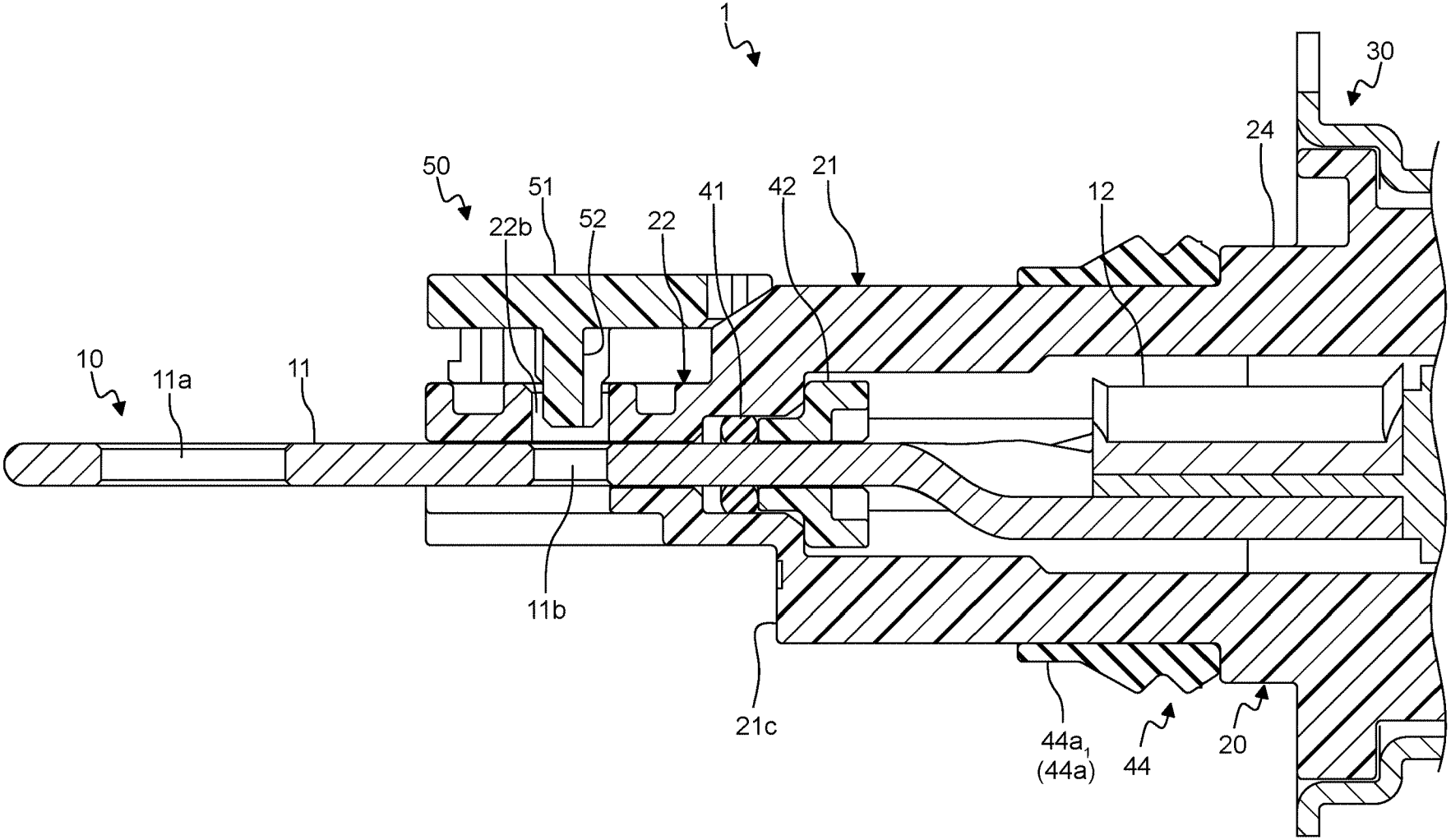
FIG. 5 is a diagram corresponding to the X1-X1 line section of FIG. 2, representing that the terminal locking member is at a temporary locked position.
Figure 8:
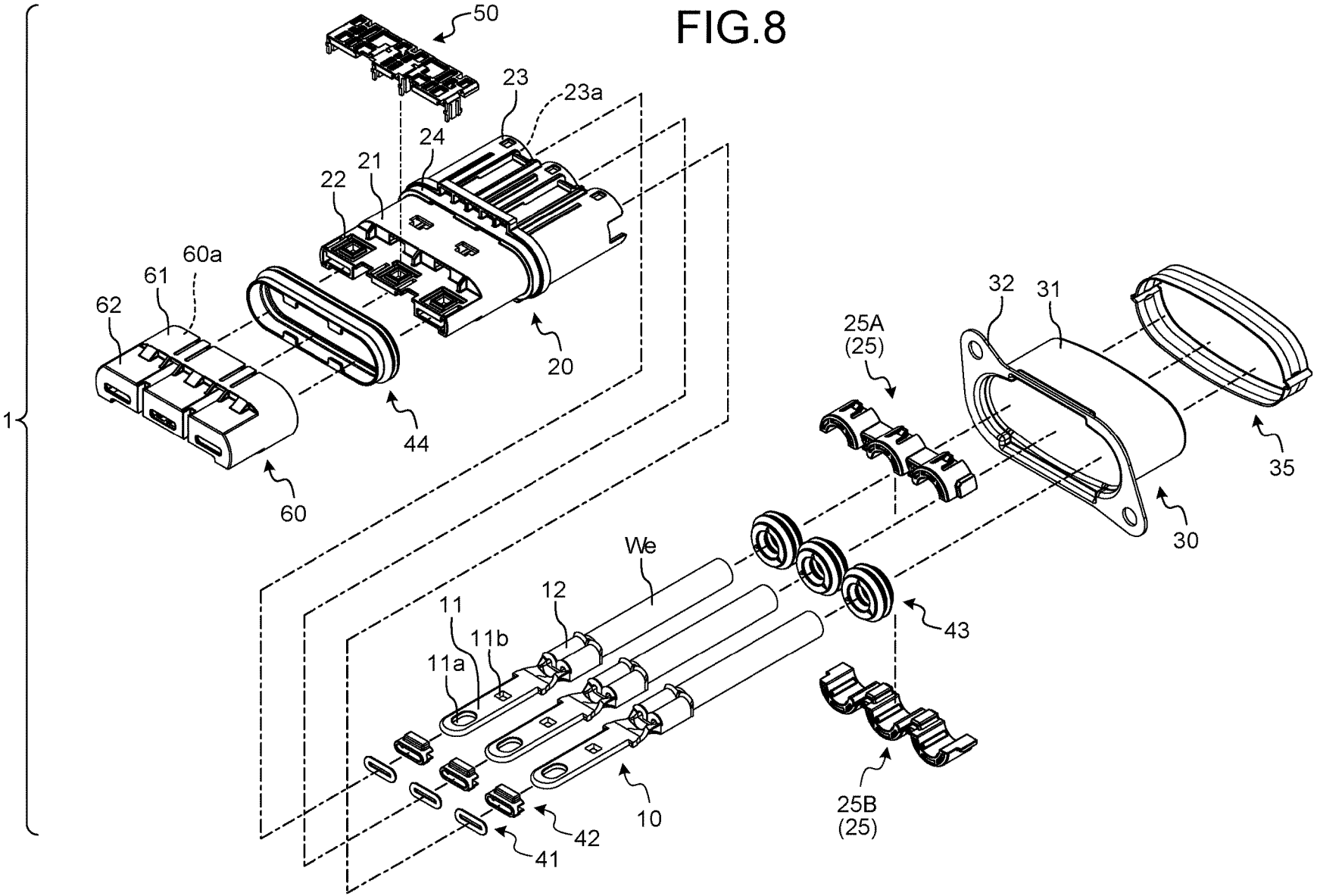
FIG. 8 is an exploded perspective view of the connector of the embodiment.

The terminal metal parts 10 are molded of a conductive material such as metal. These terminal metal parts 10 are molded into a certain shape by press molding such as bending and cutting on a metal plate as a matrix, for example. These terminal metal parts 10 are mounted on respective ends of the electric wires We in order to be electrically connected to the electric wires We. These terminal metal parts 10 are electrically connected to the counterpart terminal metal parts. Thus, these terminal metal parts 10 have respective terminal connecting parts 11 to be physically and electrically connected to the respective counterpart terminal metal parts and respective electric wire connecting parts 12 to be physically and electrically connected to the respective ends of the electric wires We (FIG. 3, FIG. 5, and FIG. 8).

A terminal connecting part 11 illustrated herein is formed in a piece body shape (FIG. 1, FIG. 3, FIG. 5, and FIG. 8). This terminal connecting part 11 is formed with a through hole 11*a*. This terminal connecting part 11 is fixed to a counterpart terminal metal part with screws, for example, via the through hole 11*a* to be physically and electrically connected to this counterpart terminal metal part. For this connection form between the terminal metal parts 10 and the counterpart terminal metal parts, such a screw fixing structure is not necessarily employed. The terminal metal parts 10 and the counterpart terminal metal parts may have mutually fittingly connectable shapes, with one of them molded in a female terminal shape and the other of them molded in a male terminal shape, for example.

An electric wire connecting part 12 is crimped or welded, for example, to a core of an end of an electric wire We to be physically and electrically connected to this electric wire We. The electric wire connecting part 12 illustrated herein causes two barrel pieces to be swaged to the bare core to be crimped to the core.

This exemplified terminal metal part 10 is molded in a straight shape in which the terminal connecting part 11 and the electric wire connecting part 12 are placed on a straight line. Thus, the electric wire We is drawn out of the electric wire connecting part 12 in an extension direction of the terminal metal part 10 along the straight line. However, in this terminal metal part 10, the terminal connecting part 11 and the electric wire connecting part 12 may be placed crossing each other, such as they are placed orthogonal to each other.

The connector 1 illustrated herein includes three pairs of a combination of the terminal metal part 10 and the electric wire We, which are paired with each other.

The housing 20 is molded of an insulating material such as synthetic resin. This housing 20 houses the terminal metal part 10 at a housing completion position thereinside and also houses the end of the electric wire We connected to the electric wire connecting part 12 of this terminal metal part 10 thereinside. In this housing 20, the terminal metal part 10 is held as it is housed at the housing completion position, whereas the electric wire We is drawn outside from inside. This housing 20 is inserted and fit into the counterpart fitting portion headed by the tip, thereby causing the terminal metal part 10 at the housing completion position to be electrically connected to the counterpart terminal metal part.

This housing 20 has a fitting part 21 housing the terminal metal parts 10 thereinside and to be inserted and fit into the counterpart fitting portion 521 (FIG. 3 to FIG. 10). The fitting part 21 is inserted and fit into the counterpart fitting portion 521 along the insertion direction and is removed from inside the counterpart fitting portion 521 along the removal direction, which is opposite thereto. This fitting part 21 is formed in a tubular shape with the insertion-and-removal direction (the insertion direction or the removal direction) into and from the counterpart fitting portion 521 as a tubular axial direction. Thus, in the following, the insertion-and-removal direction may be referred to as the tubular axial direction. The fitting part 21 illustrated herein is formed in a tubular shape with a section orthogonal to the tubular axis being oval-shaped to place three terminal metal parts 10 in parallel along a longitudinal direction of the oval. The fitting part 21 illustrated herein houses a portion of the terminal connecting part 11 closer to the electric wire connecting part 12 and a portion of the electric wire connecting part 12 closer to the terminal connecting part 11 thereinside. Inside this fitting part 21, partitioning walls (not illustrated) are each provided between the terminal metal parts 10 adjacent to each other.

This fitting part 21 has end faces 21*b* and 21*c* at ends on an insertion direction side and ends on an outer circumferential wall face 21*a* side in a direction orthogonal to the insertion direction and an arrangement direction of the three terminal metal parts 10 (FIG. 4, FIG. 6, FIG. 7, and FIG. 10). The end faces 21*b* and 21*c* are formed as planes orthogonal to the insertion-and-removal direction.

Figure 9:
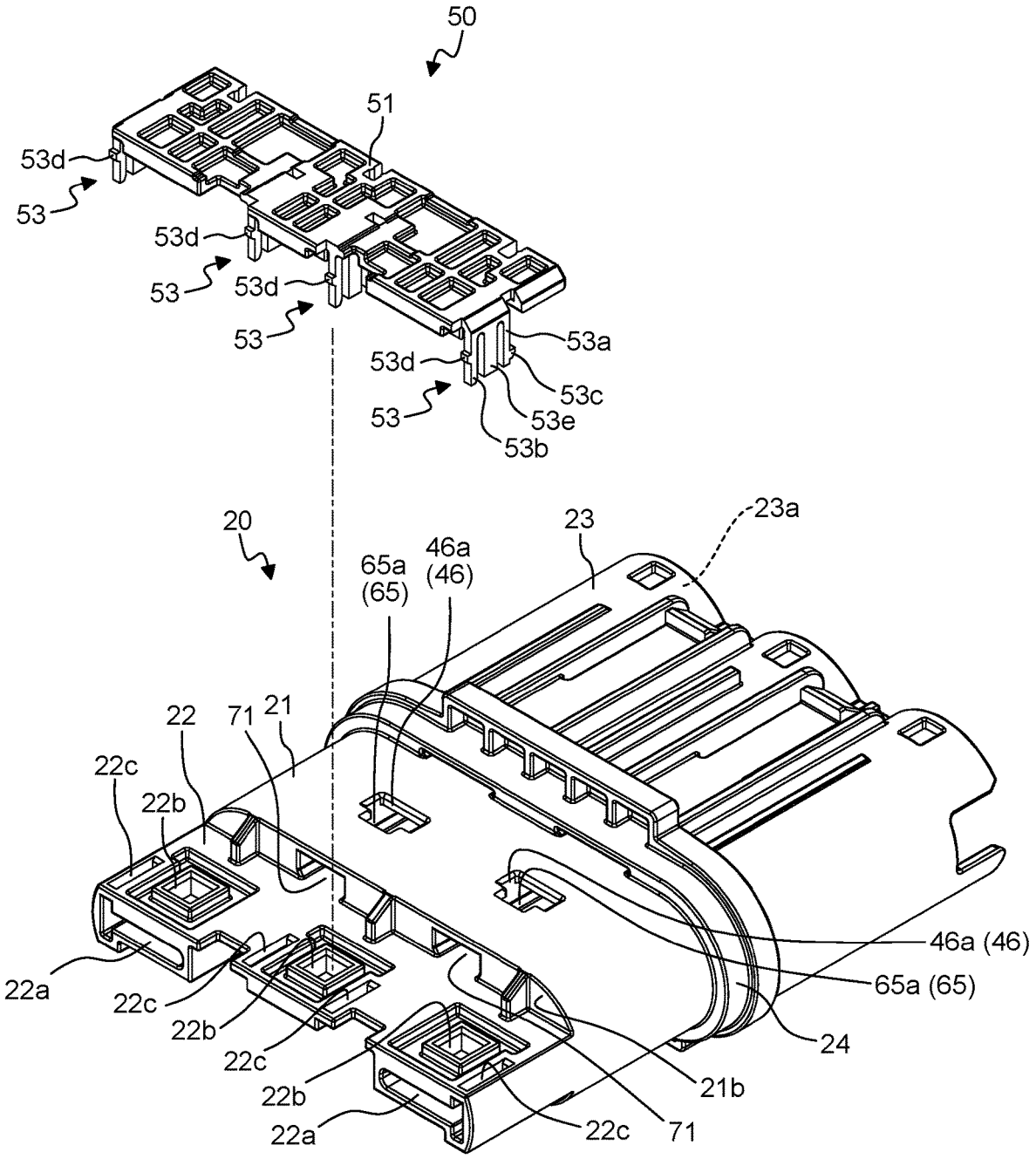
FIG. 9 an exploded perspective view of a housing and the terminal locking member.
Figure 10:
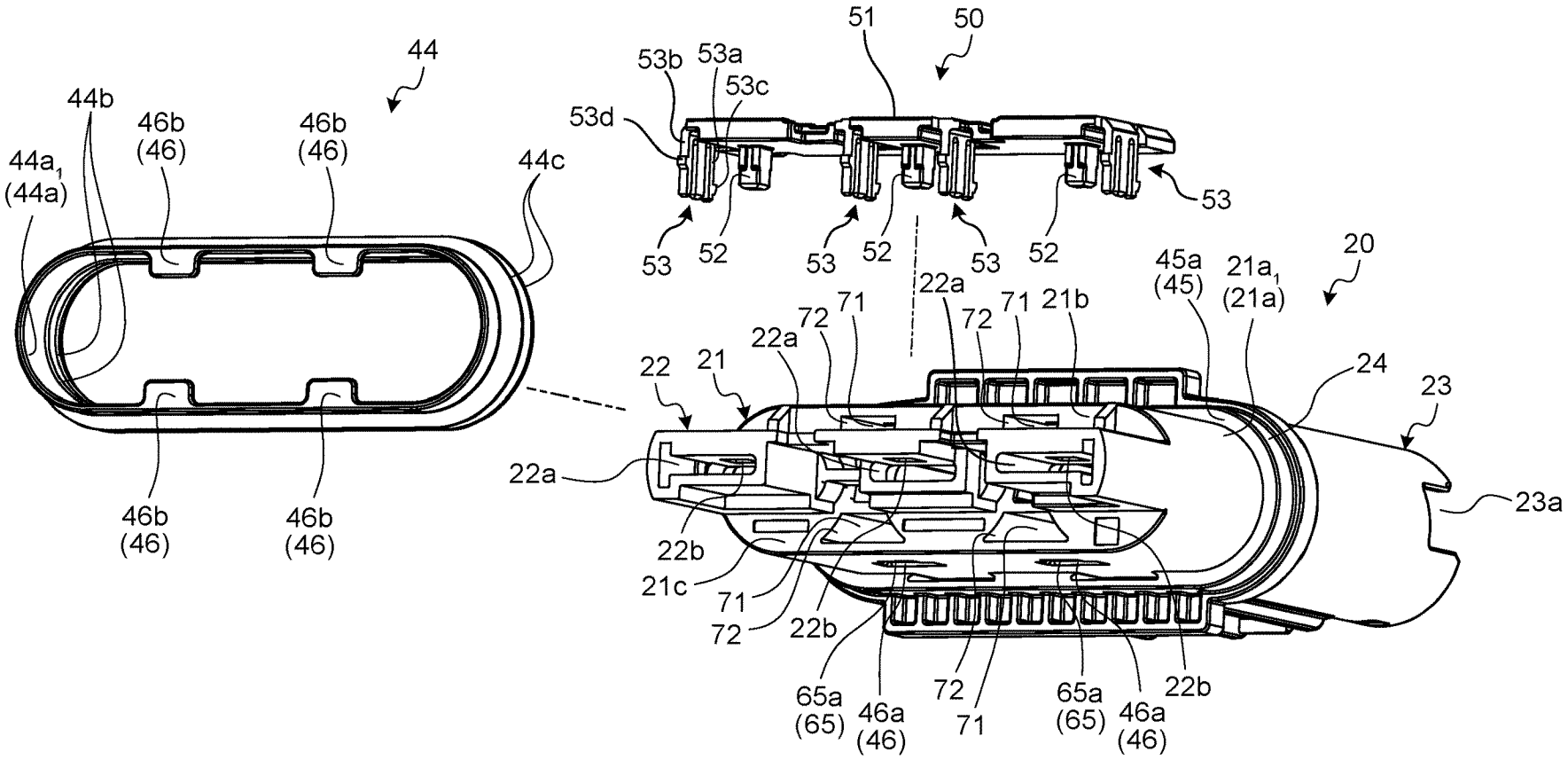
FIG. 10 is an exploded perspective view of the housing, a water stop member, and the terminal locking member viewed from another angle.

This housing 20 has a protruding part 22 protruding, between the end faces 21*b* and 21*c* of the fitting part 21, toward the insertion direction side from the end faces 21*b* and 21*c* (FIG. 3 to FIG. 10). The protruding part 22 houses the terminal metal parts 10 thereinside. This protruding part 22 may be provided for each of the terminal metal parts 10 or be provided as one protrusion housing all the terminal metal parts 10. The protruding part 22 illustrated herein houses all the terminal metal parts 10 and has a housing chamber 22*a* for each of the terminal metal parts 10 (FIG. 9 and FIG. 10). The housing chamber 22*a* houses the terminal connecting part 11 thereinside and causes an end of this terminal connecting part 11 closer to the through hole 11*a* to protrude outside from inside.

In this connector 1, a ring-shaped water stop member (what is called an O ring) 41 (FIG. 3, FIG. 5, and FIG. 8) is mounted on the terminal connecting part 11, and this water stop member 41 fills a ring-shaped gap between an inner circumferential face of the housing chamber 22*a* and the terminal connecting part 11. A ring-shaped holding member 42 (FIG. 3, FIG. 5, and FIG. 8) is mounted on the terminal connecting part 11, and this holding member 42 holds the water stop member 41.

The connector 1 includes a terminal locking member 50 mounted on the housing 20 from outside along a direction crossing the insertion direction and locking the terminal metal parts 10 as they are at the housing completion position at a mounting completion position (FIG. 3 to FIG. 10). This terminal locking member 50 is mounted on the tip side of the housing 20. The terminal locking member 50 illustrated herein is mounted on the protruding part 22 at the tip of the housing 20 and locks the terminal metal parts 10 at the housing completion position as they are housed by this protruding part 22, for example. This terminal locking member 50 has protrusions 52 protruding from a plate-like main body 51 for the respective terminal metal parts 10 (FIG. 3, FIG. 5, and FIG. 10). A protrusion 52 is inserted into a through hole 11*b* as a locked part formed in the terminal connecting part 11, thereby locking relative movement of this terminal connecting part 11 with respect to the protruding part 22 (FIG. 3, FIG. 5, and FIG. 8). The protruding part 22 has through holes (hereinafter, referred to as "first through holes") 22*b* formed for the respective protrusions 52 (FIG. 3, FIG. 5, FIG. 9, and FIG. 10).

Two at both ends among the three first through holes 22*b* illustrated herein are holes communicating with the respective housing chambers 22*a* at both ends to cause the housing chambers 22*a* at both ends to communicate with the outside. These first through holes 22*b* at both ends, when the terminal locking member 50 is mounted on the protruding part 22, causes the protrusions 52 at both ends having been inserted from outside to pass therethrough and cause the protrusions 52 at both ends to enter the inside of the housing chambers 22*a* at both ends to insert the protrusions 52 at both ends into the respective through holes 11*b* of the respective terminal connecting parts 11 within the respective housing chambers 22*a* at both ends. The residual, central first through hole 22*b*, when the terminal locking member 50 is mounted on the protruding part 22, causes the central protrusion 52 having been inserted from outside to pass therethrough to insert the central protrusion 52 into the through hole 11*b* of the terminal connecting part 11 protruding from the central housing chamber 22*a*.

The terminal locking member 50 illustrated herein is locked to the housing 20 at a temporary locked position enabling the terminal metal parts 10 to be removed from and inserted into the housing 20 and a full locked position as the mounting completion position disabling the terminal metal parts 10 to be removed from and inserted into the housing 20. Specifically, the temporary locked position refers to a locked position of the terminal locking member 50 with respect to the housing 20 enabling the terminal metal parts 10 to be inserted into the housing completion position of the housing 20 and enabling the terminal metal parts 10 at the housing completion position to be removed from the housing 20, that is, a locked position of the terminal locking member 50 with respect to the housing 20 enabling the protrusions 52 to remain within the respective first through holes 22*b*. On the other hand, the full locked position refers to a locked position of the terminal locking member 50 with respect to the housing 20 disabling the terminal metal parts 10 to be inserted into the housing completion position of the housing 20 and disabling the terminal metal parts 10 at the housing completion position to be removed from the housing 20, that is, a locked position of the terminal locking member 50 with respect to the housing 20 enabling the protrusions 52 to keep protruding from the respective first through holes 22*b* after having passed through the respective first through holes 22*b*.

The terminal locking member 50 has locked bodies 53 enabling it to be locked to the housing 20 at the temporary locked position and the full locked position thereof (FIG. 4, FIG. 6, FIG. 9, and FIG. 10). A locked body 53 has a first flexible part 53*a* cantilevered and provided with flexibility protruding in the same direction as that of the protrusion 52, a second flexible part 53*b* protruding in the same direction and with the same length as those of this first flexible part 53*a*, placed facing the first flexible part 53*a* spaced apart therefrom, and cantilevered and provided with flexibility, a first projection part 53*c* protruding toward a side opposite to the second flexible part 53*b* closer to a free end of the first flexible part 53*a*, and a second projection part 53*d* protruding toward a side opposite to the first flexible part 53*a* closer to a fixed end of the second flexible part 53*b* than to a free end thereof. The terminal locking member 50 illustrated herein has a piece part 53*e* formed in a rectangular piece shape between the first flexible part 53*a* and the second flexible part 53*b*.

Figure 4:
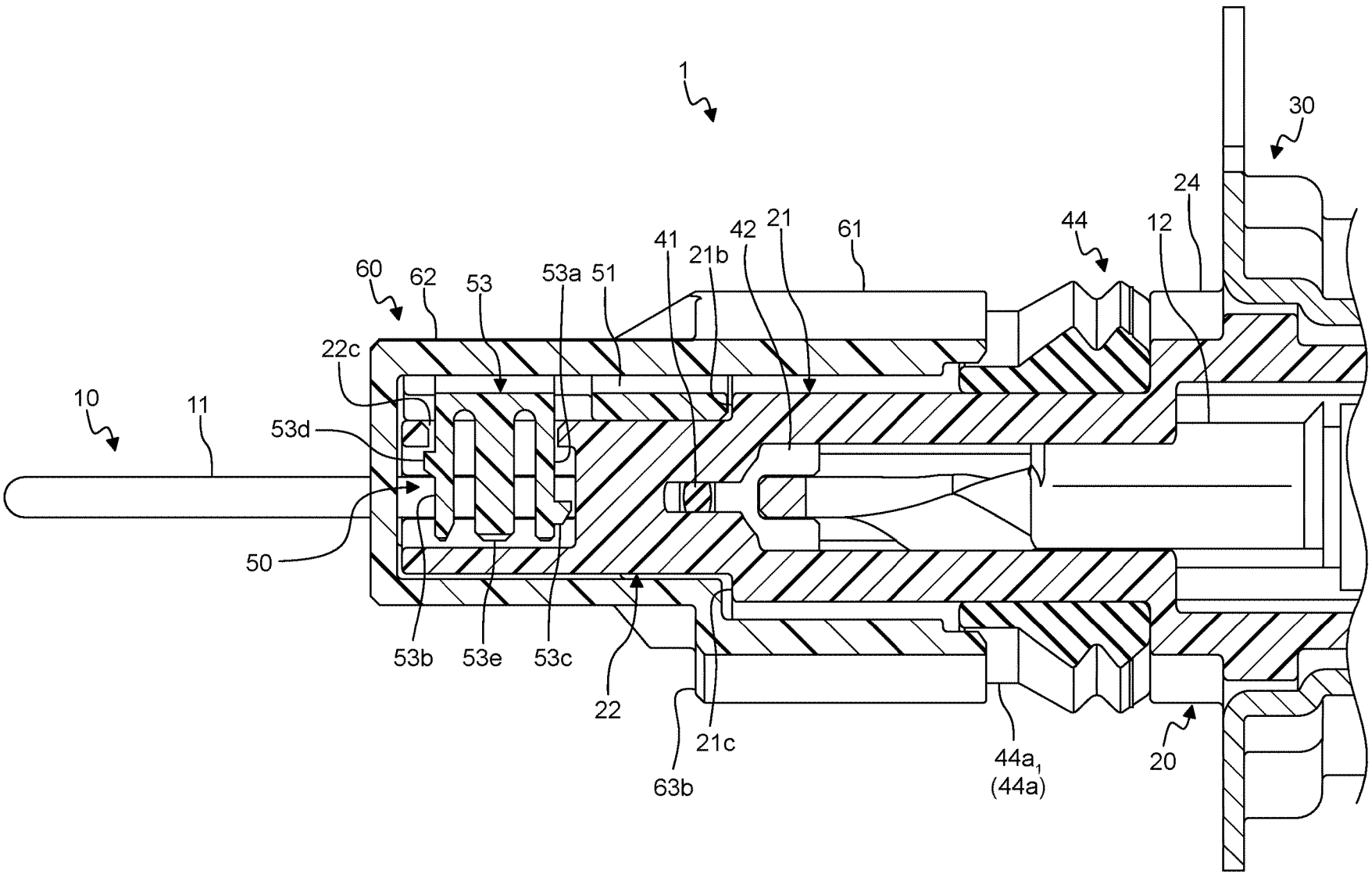
FIG. 4 is an X2-X2 line sectional view of FIG. 2, representing that the terminal locking member is at the full locked position.
Figure 6:
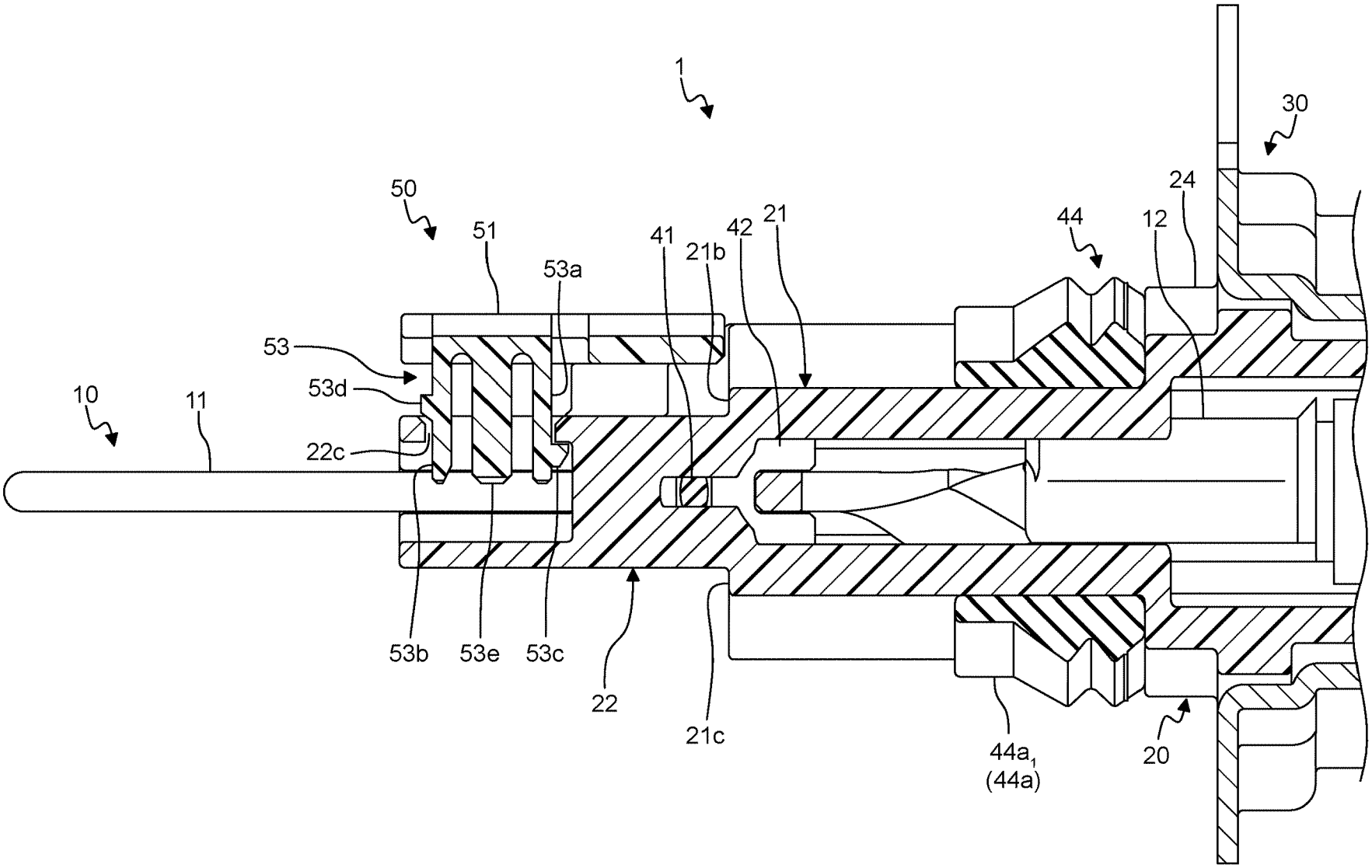
FIG. 6 is a diagram corresponding to the X2-X2 line section of FIG. 2, representing that the terminal locking member is at the temporary locked position.

The housing 20 is formed with through holes (hereinafter, referred to as "second through holes") 22*c* causing the respective locked bodies 53 to be inserted (FIG. 4, FIG. 6, and FIG. 9). In this example, the second through holes 22*c* are formed in a flat plate part of the protruding part 22 with a direction orthogonal to the plane as a hole axial direction. The terminal locking member 50 locks the first projection part 53*c* to one plane of the flat plate part of the protruding part 22, or a plane on a side of a protruding direction of the first flexible part 53*a* and the second flexible part 53*b*, at a peripheral part of the second through hole 22*c*, locks the second projection part 53*d* to the other plane of the flat plate part of the protruding part 22, or a plane on a side opposite to the protruding direction of the first flexible part 53*a* and the second flexible part 53*b*, at the peripheral part of the second through hole 22*c*, and is thereby locked to the protruding part 22 at the temporary locked position. This terminal locking member 50 locks the second projection part 53*d* to the one plane of the flat plate part of the protruding part 22 at the peripheral part of the second through hole 22*c* and is thereby locked to the protruding part 22 at the full locked position. Thus, the first projection part 53*c* and the second projection part 53*d* are placed shifted with respect to each other with a spacing equivalent to the length of the second through hole 22*c* in the hole axial direction (in other words, the plate thickness of the protruding part 22 in the flat plate part) in the protruding direction of the first flexible part 53*a* and the second flexible part 53*b*.

The first flexible part 53*a* and the second flexible part 53*b* illustrated herein are formed in a rectangular parallelepiped axial shape with their own protruding direction as a longitudinal direction and are placed with their mutual planes facing each other, for example. The first projection part 53*c* illustrated herein protrudes in a hook shape from a plane on the side opposite to the second flexible part 53*b* closer to the free end of the first flexible part 53*a*, or a protrusion's side plane. The second projection part 53*d* illustrated herein protrudes in a hook shape from a plane on the side opposite to the first flexible part 53*a* at substantially the center of the second flexible part 53*b*, or a protrusion's side plane. The second through hole 22*c* illustrated herein is formed in a rectangular parallelepiped shape. This second through hole 22*c* is formed such that the spacing between two wall faces facing each other is equivalent to the spacing between the respective protrusion's side planes of the first flexible part 53*a* and the second flexible part 53*b* that are not in an elastically deformed state. Thus, respective slanted faces receiving force from the peripheral part of the second through hole 22*c* of the protruding part 22 to cause the first flexible part 53*a* and the second flexible part 53*b* to become elastically deformed toward the inside of the second through hole 22*c* are provided in the first projection part 53*c* and the second projection part 53*d* on the free end side of the first flexible part 53*a* and the second flexible part 53*b*.

The terminal locking member 50 illustrated herein is formed with the locked bodies 53 at four places with each one of the protrusions 52 placed therebetween. The protruding part 22 illustrated herein is formed with the second through holes 22*c* for the respective locked bodies 53.

In the terminal locking member 50, all the locked bodies 53 are inserted into the respective second through holes 22*c* headed by the respective free ends of the first flexible part 53*a* and the second flexible part 53*b* and all the protrusions 52 are inserted into the respective first through holes 22*b* headed by their ends on the protruding direction side. Thus, in this terminal locking member 50, the first flexible part 53*a* becomes elastically deformed via the first projection part 53*c* pushed by the wall face of the second through hole 22*c*, and when the first projection part 53*c* has passed through the second through hole 22*c*, the elastic deformation of the first flexible part 53*a* is relaxed, thus locking this first projection part 53*c* to the one plane of the flat plate part of the protruding part 22 at the peripheral part of the second through hole 22*c* and locking the second projection part 53*d* to the other plane of the flat plate part of the protruding part 22 at the peripheral part of the second through hole 22*c*. Consequently, this terminal locking member 50 is locked to the protruding part 22 at its temporary locked position as the respective protrusions 52 remain within the respective first through holes 22*b*.

In this connector 1, when the terminal locking member 50 is at the temporary locked position, the terminal metal parts 10 are inserted up to the housing completion position of the housing 20.

Subsequently, in this terminal locking member 50, by being pushed toward the protruding part 22 from its temporary locked position, the second flexible part 53*b* becomes elastically deformed via the second projection part 53*d* pushed by the wall face of the second through hole 22*c*, and when the second projection part 53*d* has having passed through the second through hole 22*c*, the elastic deformation of the second flexible part 53*b* is relaxed, thus locking this second projection part 53*d* to the one plane of the flat plate part of the protruding part 22 at the peripheral part of the second through hole 22*c*. Consequently, this terminal locking member 50 is locked to the protruding part 22 at its full locked position as the respective protrusions 52 protrude from the respective first through holes 22*b* and are inserted into the respective through holes 11*b* of the respective terminal connecting parts 11. Thus, in this connector 1, when the terminal locking member 50 is at the full locked position, the terminal metal parts 10 can be kept at the housing completion position of the housing 20.

In this connector 1, the terminal locking member 50 at the full locked position is moved to the temporary locked position, whereby the terminal metal parts 10 can be removed from the housing 20.

With the fitting part 21 inserted and fit into the counterpart fitting portion 521, the housing 20 causes its portion on the removal direction side of the fitting part 21 to protrude from the counterpart fitting portion 521. This housing 20 has tubular electric wire housing parts 23 housing the respective electric wires We thereinside as protruding portions from the counterpart fitting portion 521 on the removal direction side (FIG. 1 and FIG. 8 to FIG. 10). The electric wire housing parts 23 illustrated herein are formed in a cylindrical shape and are provided for the respective electric wires We. The electric wire housing parts 23 are arranged in the arrangement direction of the three terminal metal parts. This housing 20 has a tube part 24 concentric with the tubular axis of the fitting part 21 and provided outside the outer circumferential wall face 21*a* of this fitting part 21 between the fitting part 21 and the electric wire housing parts 23 (FIG. 1 and FIG. 3 to FIG. 10). The tube part 24 illustrated herein is formed in a tubular shape with a section orthogonal to the tubular axis being oval-shaped.

In this housing 20, the electric wire We with the terminal metal part 10 is inserted through an opening 23*a* of an electric wire housing part 23 (FIG. 8 to FIG. 10). Thus, the electric wire We is drawn outside from the opening 23*a*. An annular gap is formed between the electric wire housing part 23 and the electric wire We. Given this, in this connector 1, the electric wire We is first passed through an annular water stop member (what is called a rubber stopper) 43 (FIG. 8), and then the water stop member 43 is inserted into the electric wire housing part 23 together with the electric wire We, thereby filling the annular gap between the electric wire housing part 23 and the electric wire We.

In this connector 1, a rear holder 25 holding the electric wire We while reducing the bending of the electric wire We is mounted on between the opening 23*a* of the electric wire housing part 23 and the water stop member 43 (FIG. 8). This exemplified rear holder 25 has a structure with two parts including a first holder member 25A and a second holder member 25B, in which the first holder member 25A and the second holder member 25B put the electric wire We therebetween to hold it. The electric wire We is drawn outside from the opening 23*a* via this rear holder 25. Although details are not described, respective hook parts provided in the first holder member 25A and the second holder member 25B are inserted into through holes of the electric wire housing parts 23, whereby this rear holder 25 is held by the electric wire housing parts 23. The first holder member 25A and the second holder member 25B are molded of an insulating material such as synthetic resin, for example.

The shield shell 30 covers the electric wire housing parts 23 from outside to inhibit intrusion of noise from outside to the electric wires We thereinside. Thus, this shield shell 30 is molded of a metallic material (aluminum or an aluminum alloy, for example).

This shield shell 30 has a tube part 31 covering the electric wire housing parts 23 from outside and a flange part 32 covering a portion of the tube part 24 closer to the electric wire housing parts 23 from outside (FIG. 1 and FIG. 8). The tube part 31 is formed in a tubular shape with a section orthogonal to a tubular axis being oval-shaped and places the three electric wire housing parts 23 in parallel along a longitudinal direction of the oval. The flange part 32 is formed in a ring, flat plate shape concentric with the tubular axis of the tube part 31 and protruding outside from an outer circumferential face of this tube part 31. This flange part 32 brings its plane into plane contact with a plane of the housing 501 and is fixed to this housing 501 with screws.

This connector 1 includes braiding (not illustrated) covering the outer circumferential face of this tube part 31 and the electric wires We drawn outside from respective openings 23*a*. The braiding is a member braided in a tubular, reticulated shape with a metallic material and inhibits intrusion of noise to the electric wires We drawn outside from the respective openings 23*a*. This braiding is brought into pressing contact with the outer circumferential face of the tube part 31 using a tubular connecting member 35 (FIG. 1 and FIG. 8).

The connector 1 includes a front holder 60 causing the housing 20 to be inserted headed by the tip (that is, the protruding part 22) and locking the terminal locking member 50 at the full locked position (the mounting completion position) (FIG. 1 to FIG. 4, FIG. 7, and FIG. 8). This front holder 60 locks at least part of the main body 51 of the terminal locking member 50 at the full locked position so that the terminal locking member 50 is kept at the full locked position. The front holder 60 illustrated herein covers and locks the entire main body 51 of the terminal locking member 50 at the full locked position from outside so that the terminal locking member 50 is kept at the full locked position. Thus, the front holder 60 illustrated herein is molded such that the protruding part 22 is inserted thereinto together with the terminal locking member 50 at the full locked position. In this example, the front holder 60 is molded such that the fitting part 21 and the protruding part 22 are inserted thereinto together with the terminal locking member 50 at the full locked position.

Into this front holder 60, the fitting part 21, the protruding part 22, and the terminal locking member 50 at the full locked position are inserted through an insertion port 60*a* (FIG. 8) along the insertion direction. This front holder 60 locks the terminal locking member 50 at the full locked position to prevent falling of the terminal locking member 50 from the protruding part 22 and thereby holds the terminal metal parts 10 at the housing completion position housed together with the fitting part 21 and the like inside the housing 20 as they are at the housing completion position.

Figure 7:
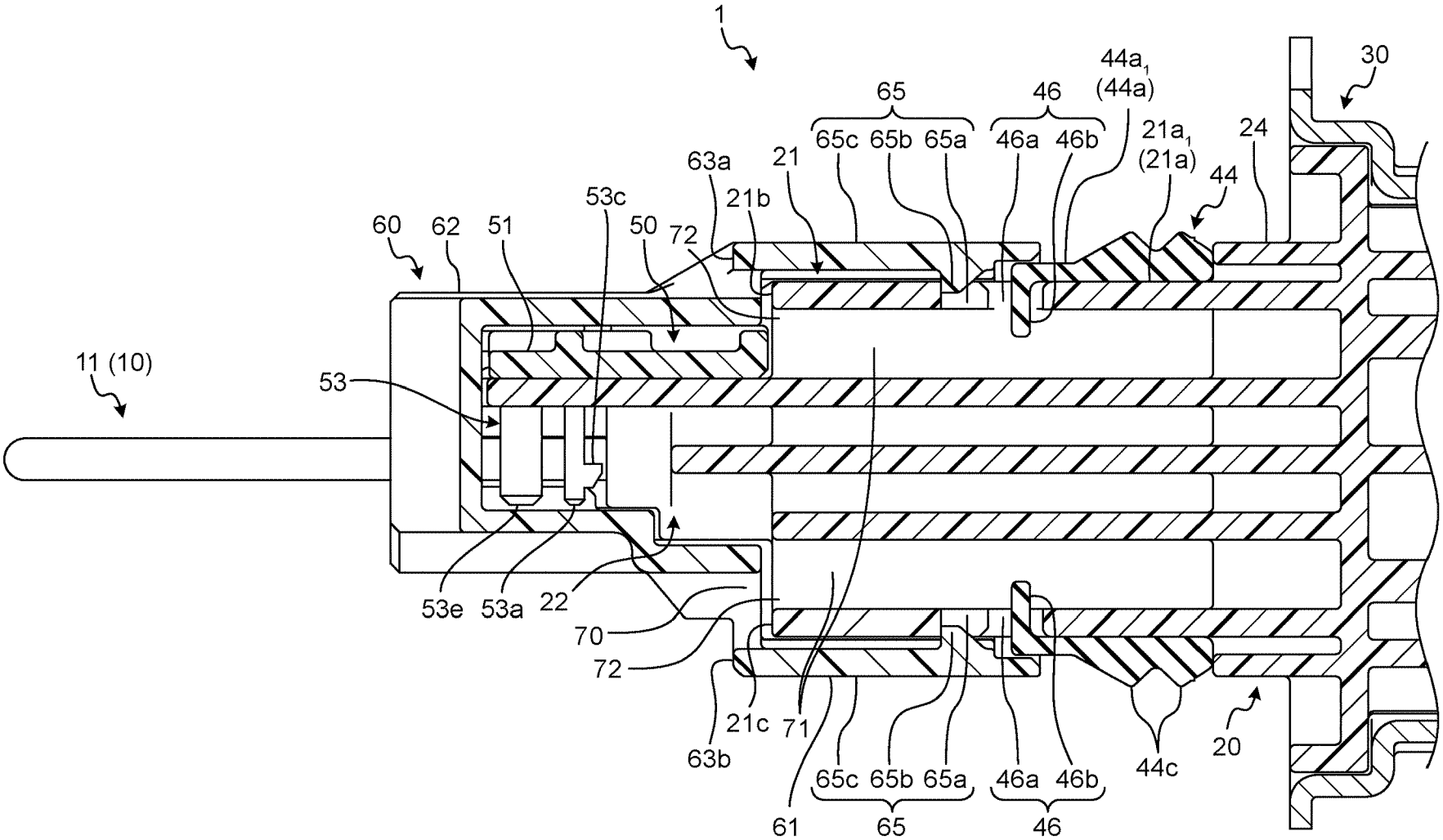
FIG. 7 is an X3-X3 line sectional view of FIG. 2.

This front holder 60 has a tube part (hereinafter, referred to as a "first tube part") 61 causing the fitting part 21 to be inserted and a tube part (hereinafter, referred to as a "second tube part") 62 causing the protruding part 22 to be inserted together with the terminal locking member 50 (FIG. 1 to FIG. 4, FIG. 7, and FIG. 8). This front holder 60 has facing wall parts 63*a* and 63*b* provided on one end of the first tube part 61 on the insertion direction side and placed facing the end faces 21*b* and 21*c*, respectively, of the fitting part 21 on the insertion direction side (FIG. 3, FIG. 4, and FIG. 7). In this example, the end face 21*b* and the facing wall part 63*a* are placed facing each other, whereas the end face 21*c* and the facing wall part 63*b* are placed facing each other.

The first tube part 61 is formed in a tubular shape concentric with the tubular axis of the fitting part 21 and with a section orthogonal to the tubular axis being oval-shaped. The front holder 60 is held by the fitting part 21 through a holding mechanism 65 provided between this first tube part 61 and the fitting part 21 (FIG. 7). The holding mechanism 65 illustrated herein places a locking part 65*a* provided on the outer circumferential wall face 21*a* of the fitting part 21 and a locked part 65*b* provided on the first tube part 61 in a mutually lockable state within a range of a permitted mutual movement amount in terms of design in the insertion-and-removal direction. Thus, this holding mechanism 65 locks relative movement between the fitting part 21 and the first tube part 61 in the insertion-and-removal direction within the range of the permitted mutual movement amount to hold the front holder 60 by the fitting part 21. The locking part 65*a* is formed as a groove or a through hole in the outer circumferential wall face 21*a* of the fitting part 21. The locked part 65*b* is formed as a hook part to be inserted into the locking part 65*a* as the groove or the through hole and to be locked to an inner circumferential wall face of the groove or the through hole. The first tube part 61 illustrated herein has a cantilevered piece part 65*c* provided with flexibility extending in a tubular axial direction and causes the locked part 65*b* to protrude from a free end of the piece part 65*c*. Such a holding mechanism 65 is provided at four places between the fitting part 21 and the first tube part 61 illustrated herein. In this example, two holding mechanisms 65 are provided at each of the ends on the outer circumferential wall face 21*a* side in the direction orthogonal to the insertion direction and the arrangement direction of the three terminal metal parts 10.

The second tube part 62 protrudes, between the facing wall parts 63*a* and 63*b* on one end of the first tube part 61 in the tubular axial direction, toward the insertion direction side from the facing wall parts 63*a* and 63*b*. This second tube part 62 houses the terminal locking member 50 at the full locked position (the mounting completion position) together with the protruding part 22 thereinside and covers and locks the main body 51 of the terminal locking member 50 at the full locked position by its own inner circumferential face so that the terminal locking member 50 is kept at the full locked position. This second tube part 62 causes the ends of the terminal connecting parts 11 closer to the through holes 11*a* to protrude from inside.

In the front holder 60 illustrated herein, an opening on the other end of the first tube part 61 in the tubular axial direction is used as the insertion port 60*a*. The front holder 60 illustrated herein causes a portion of the fitting part 21 on the removal direction side to protrude from the insertion port 60*a*. Thus, in this front holder 60, a ring-shaped end face of the first tube part 61 on the insertion port 60*a* side is placed facing a ring-shaped end face of the tube part 24 of the housing 20 spaced apart therefrom in the insertion-and-removal direction. This connector 1 is formed with a ring-shaped groove with the outer circumferential wall face 21*a* of the fitting part 21 as a groove bottom between the ring-shaped end face of the first tube part 61 on the insertion port 60*a* side and the ring-shaped end face of the tube part 24 of the housing 20. This connector 1 is provided with a ring-shaped water stop member 44 in the ring-shaped groove (FIG. 1 to FIG. 8 and FIG. 10).

The water stop member 44 is molded of an elastically deformable synthetic resin material such as rubber. This water stop member 44 has a tubular base part 44*a*, a concentric, ring-shaped lip protruding from an inner circumferential face of this base part 44*a* (hereinafter, referred to as an "inner circumferential lip") 44*b*, and a concentric, ring-shaped lip protruding from an outer circumferential face of this base part 44*a* (hereinafter, referred to as an "outer circumferential lip") 44*c* (FIG. 10). In this water stop member 44, a plurality of inner circumferential lips 44*b* and a plurality of outer circumferential lips 44*c* are arranged in a tubular axial direction of the base part 44*a*. The water stop member 44 illustrated herein is provided with two each of the inner circumferential lips 44*b* and the outer circumferential lips 44*c*. The base part 44*a* illustrated herein is formed in a tubular shape with a section orthogonal to the tubular axis being oval-shaped. The inner circumferential lips 44*b* and the outer circumferential lips 44*c* illustrated herein are formed in a ring shape with a section orthogonal to the tubular axis of the base part 44*a* being oval-shaped.

An inner circumferential side of this water stop member 44 is fit to a protruding portion 21$a_1$ of the outer circumferential wall face 21*a* of the fitting part 21 from the insertion port 60*a* of the front holder 60 (FIG. 7). When mounted on the protruding portion 21$a_1$, this water stop member 44 causes the inner circumferential lips 44*b* on the inner circumferential side to become elastically deformed to bring the inner circumferential lips 44*b* into intimate contact with the protruding portion 21$a_1$. When the fitting part 21 and the counterpart fitting portion 521 are in an inserted-and-fit state, this water stop member 44 causes the outer circumferential lips 44*c* on the outer circumferential side to become elastically deformed to bring the outer circumferential lips 44*c* into intimate contact with the inner circumferential wall face 521*a* of the counterpart fitting portion 521. The water stop member 44 thus fills a ring-shaped gap between the protruding portion 21$a_1$ of the outer circumferential wall face 21*a* and the inner circumferential wall face 521*a* of the counterpart fitting portion 521 to inhibit intrusion of liquid such as water from between the fitting part 21 and the counterpart fitting portion 521 to the inside of the housing 501.

In the water stop member 44 illustrated herein, the base part 44*a* protrudes from the inner circumferential lips 44*b* and the outer circumferential lips 44*c* on one side in the tubular axial direction (FIG. 7). In this example, a protruding portion 44$a_1$ of the base part 44*a* is placed closer to the first tube part 61 of the front holder 60. The first tube part 61 is caused to cover an outer circumferential face of an end of the protruding portion 44$a_1$ on the insertion direction side. That is to say, an end of this first tube part 61 on the insertion port 60*a* side is caused to have a peeling inhibition function to inhibit peeling or the like of the base part 44*a*.

This water stop member 44 is positioned on the tubular axis with respect to the fitting part 21 by the housing 20 and the front holder 60. A positioning mechanism in the tubular axial direction (hereinafter, referred to as a "first positioning mechanism") 45 includes a first locking part 45*a* using the tube part 24, a second locking part 45*b* provided in the first tube part 61 of the front holder 60, a first locked part 45*c* using another end face of the base part 44*a* in the tubular axial direction, and a second locked part 45*d* using one end face of the base part 44*a* in the tubular axial direction, or an end face of the protruding portion 44$a_1$ (FIG. 3). In this first positioning mechanism 45, the first locking part 45*a* and the first locked part 45*c* are placed facing each other in the tubular axial direction, whereas the second locking part 45*b* and the second locked part 45*d* are placed facing each other in the tubular axial direction. This first positioning mechanism 45 is set such that a total value of the spacing between the first locking part 45*a* and the first locked part 45*c*, which are paired with each other, in the tubular axial direction and the spacing between the second locking part 45*b* and the second locked part 45*d*, which are paired with each other, in the tubular axial direction falls under a range of a permitted mutual movement amount in terms of design of the water stop member 44 with respect to the fitting part 21 in the tubular axial direction. The permitted mutual movement amount is determined in consideration of tolerance variations or the like of the housing 20, the front holder 60, and the water stop member 44. Thus, this first positioning mechanism 45 causes the position of the water stop member 44 on the tubular axis with respect to the fitting part 21 to remain at a position within a prescribed range in terms of design. That is to say, the tube part 24 of the housing 20 illustrated herein is caused to have a locking function to lock the water stop member 44 at a fitting completion position with respect to the fitting part 21. The front holder 60 illustrated herein is caused to have the locking function to lock the water stop member 44 at the fitting completion position with respect to the fitting part 21.

This water stop member 44 includes a positioning mechanism performing positioning in the circumferential direction with respect to the fitting part 21 with the fitting part 21 (hereinafter, referred to as a "second positioning mechanism") 46 (FIG. 2, FIG. 7, FIG. 9, and FIG. 10). This second positioning mechanism 46 causes locking parts 46*a* provided in the fitting part 21 and locked parts 46*b* provided in the water stop member 44 to be placed in a mutually lockable state within a range of a permitted mutual movement amount in terms of design in the circumferential direction. The permitted mutual movement amount is determined in consideration of the tolerance variations or the like of the housing 20 and the water stop member 44. Thus, this second positioning mechanism 46 locks relative movement between the fitting part 21 and the water stop member 44 in the circumferential direction within the range of the permitted mutual movement amount to cause the position of the water stop member 44 in the circumferential direction with respect to the fitting part 21 to remain at a position within a prescribed range in terms of design.

A locking part 46*a* is formed as a groove or a through hole in the outer circumferential wall face 21*a* of the fitting part 21. This locking part 46*a* causes a locked part 46*b* to be inserted thereinto to lock the locked part 46*b*. The locking part 46*a* illustrated herein locks the inserted locked part 46*b* by one inner circumferential wall face and the other inner circumferential wall face in the circumferential direction. However, the inserted locked part 46*b* may be locked to this locking part 46*a* in the tubular axial direction of the water stop member 44. The locking part 46*a* illustrated herein is placed side by side with the locking part 65*a* of the holding mechanism 65 in the tubular axial direction and communicates with the locking part 65*a*.

The locked part 46*b* is formed as a projection part capable of being inserted into the locking part 46*a* as the groove or the through hole. This locked part 46*b* protrudes inward from the inner circumferential face of the water stop member 44. The locked part 46*b* illustrated herein protrudes from an apex of the inner circumferential lips 44*b*. The locked part 46*b* illustrated herein is formed in a piece shape having a plane being rectangular and orthogonal to the tubular axial direction.

Such a second positioning mechanism 46 is provided at four places spaced apart from each other in the circumferential direction between the fitting part 21 and the water stop member 44 illustrated herein. In this example, two second positioning mechanisms 46 are provided at each of the ends on the outer circumferential wall face 21*a* side in the direction orthogonal to the insertion direction and the arrangement direction of the three terminal metal parts 10.

This water stop member 44 varies in the position in the tubular axial direction and the circumferential direction with respect to the fitting part 21 within the prescribed range in terms of design by the tolerance variations of itself, the housing 20, and the like. Thus, in this connector 1, it is difficult to determine whether the water stop member 44 is mounted on a proper position with respect to the fitting part 21 from its appearance. The water stop member 44 is at a prescribed position in terms of design not only for the position in the circumferential direction with respect to the fitting part 21 but also for the position on the tubular axis with respect to the fitting part 21 when the locked parts 46*b* are inserted into the respective locking parts 46*a*. That is to say, if the locked parts 46*b* are inserted into the respective locking parts 46*a*, this water stop member 44 is mounted on the proper position with respect to the fitting part 21.

Figure 2:
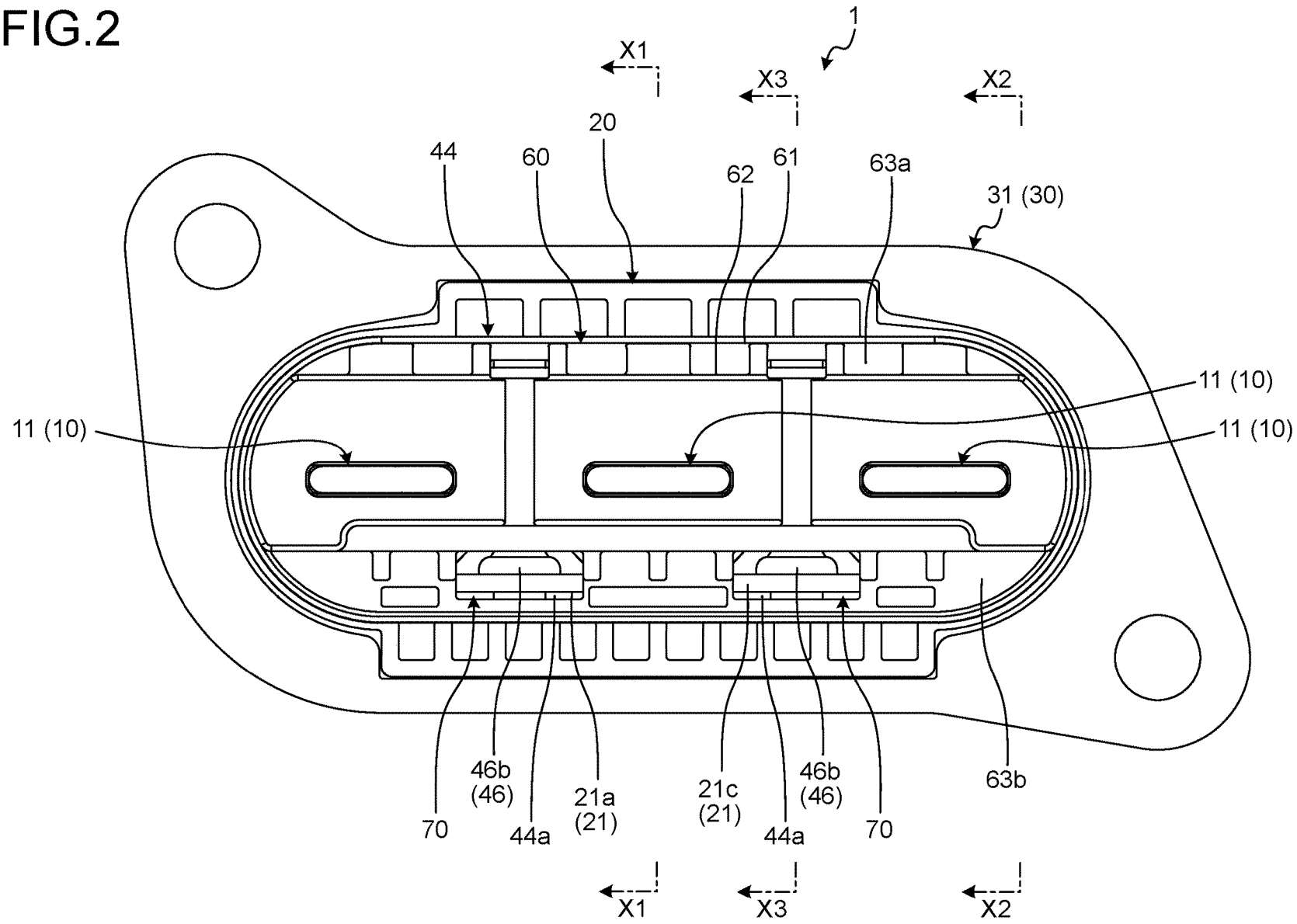
FIG. 2 is a plan view of the connector of the embodiment viewed from a viewing window part's side.

Given these circumstances, in this connector 1, one of the fitting part 21 and the front holder 60 has viewing window parts 70 communicating with the respective locking parts 46*a* of the second positioning mechanism 46 and enabling the locked parts 46*b* inserted into the locking parts 46*a* to be visually checked from outside with the front holder 60 mounted on the fitting part 21 (FIG. 2 and FIG. 7). In this connector 1, an operator checks whether the locked parts 46*b* are inserted into the locking parts 46*a* through the viewing window parts 70 and can thereby determine whether the water stop member 44 is mounted on the proper position with respect to the fitting part 21. The operator determines that the water stop member 44 is mounted on the proper position with respect to the fitting part 21 when the locked parts 46*b* can be visually checked through the viewing window parts 70 and determines that the water stop member 44 is not mounted on the proper position with respect to the fitting part 21 when the locked parts 46*b* cannot be visually checked through the viewing window parts 70. Checking through the viewing window parts 70 may be performed by the operator or a control apparatus using imaging information of an imaging apparatus (not illustrated) imaging the locking part 46*a* through the viewing window parts 70.

At least one viewing window part 70 may be provided in correspondence with combinations of the locking part 46*a* and the locked part 46*b*, which are paired with each other (that is, the second positioning mechanism 46). In this example, the second positioning mechanism 46 is provided at the four places, and the viewing window part 70 may be provided in correspondence with at least one place among the second positioning mechanisms 46 at the four places. In the connector 1 illustrated herein, one viewing window part 70 is provided for each of two second positioning mechanisms 46 at one of the ends on the outer circumferential wall face 21*a* side in the direction orthogonal to the insertion direction and the arrangement direction of the three terminal metal parts 10 (FIG. 2). In this example, as will be described below, one viewing window part 70 is provided in the facing wall part 63*b*.

Specifically, the fitting part 21 has space parts 71 communicating with the respective locking parts 46*a* inside the locking parts 46*a* and causing the locked parts 46*b* inserted into the locking parts 46*a* to enter (FIG. 7, FIG. 9, and FIG. 10). The space parts 71 are provided for the respective locking parts 46*a*. The fitting part 21 has openings 72 provided in the end faces 21*b* and 21*c* and enabling the locked parts 46*b* having entered the space parts 71 to be visually checked from outside (FIG. 7 and FIG. 10). The openings 72 are provided for the respective space parts 71. In this connector 1, if a wall body of the front holder 60 is not present on the insertion direction side of the openings 72, the openings 72 may be used as the viewing window parts 70. On the other hand, in this connector 1, if the wall body of the front holder 60 is present on the insertion direction side of the openings 72 and if a hole can be made in the wall body, the hole made in the wall body may be used as the viewing window parts 70.

As described in the foregoing, the front holder 60 illustrated herein has the facing wall parts 63*a* and 63*b* placed facing the end faces 21*b* and 21*c*, respectively, of the fitting part 21 on the insertion direction side. In the front holder 60, the viewing window parts 70 are provided in at least one of the two facing wall parts 63*a* and 63*b* (FIG. 2). The front holder 60 illustrated herein is provided with the viewing window parts 70 in the facing wall part 63*b*. The front holder 60 illustrated herein is provided with the viewing window parts 70 in correspondence with two respective openings 72 in the end face 21*c* of the fitting part 21 placed facing the facing wall part 63*b*. The viewing window parts 70 are provided in the facing wall part 63*b* and includes through holes placed facing the openings 72 of the end face 21*c* of the fitting part 21 on the insertion direction side. The viewing window parts 70 are through holes enabling the locked parts 46*b* having entered the space parts 71 to be visually checked from outside and enables the locked parts 46*b* having entered the space parts 71 to be visually checked from outside via the openings 72.

As demonstrated in the foregoing, the connector 1 of the present embodiment includes the terminal locking member 50 mounted on the housing 20 from outside and locking the terminal metal parts 10 inside the housing 20 as they are at the housing completion position at its mounting completion position and locks the terminal locking member 50 as it is at the mounting completion position with respect to the housing 20 using the front holder 60. This connector 1 has a function of locking the terminal locking member 50 by the front holder 60 and can thus keep the terminal locking member 50 at the mounting completion position with respect to the housing 20 regardless of whether the terminal locking member 50 itself has a function of remaining at the mounting completion position with respect to the housing 20. Thus, this connector 1 can keep the terminal metal parts 10 at the housing completion position even when a terminal locking body (lance) as seen in conventional ones is not provided inside the housing 20. That is to say, the connector 1 of the present embodiment enables a reduction in the entire size along with a reduction in the size of the housing 20 compared with conventional ones and can thus keep the terminal metal parts 10 at the housing completion position while achieving a reduction in the entire size.

Further, in the connector 1 of the present embodiment, using the locked bodies 53 of the terminal locking member 50 and the second through holes 22*c* of the housing 20, the terminal locking member 50 can be kept to be locked to the mounting completion position (the full locked position) with respect to the housing 20. That is to say, this connector 1 is provided with a double locking structure for keeping the terminal metal parts 10 at the housing completion position with a combination of the function of locking the terminal locking member 50 itself at the mounting completion position (the full locked position) and the function of locking the terminal locking member 50 by the front holder 60. In the connector 1 illustrated herein, the first through holes 22*b* for locking the terminal metal parts 10 at the housing completion position and the second through holes 22*c* for locking the terminal locking member 50 at the mounting completion position (the full locked position) are alternately arranged to place the second through holes 22*c* at the gaps between the terminal metal parts 10 adjacent to each other (FIG. 9), and thus the terminal locking member 50 can be locked at the mounting completion position (the full locked position) without an increase in size. Consequently, the connector 1 of the present embodiment can firmly keep the terminal metal parts 10 at the housing completion position owing to the double locking structure while achieving a reduction in size.

Still further, in the connector 1 of the present embodiment, the water stop member 44 can also be locked to the front holder 60 in its tubular axial direction so as to be kept at the fitting completion position with respect to the housing 20. Consequently, the connector 1 of the present embodiment can inhibit an increase in size also in terms of this point.

Still further, the connector 1 of the present embodiment enables whether the locked part 46*b* is inserted into the locking part 46*a* to be visually checked through the viewing window part 70, whereby whether the water stop member 44 is mounted on the proper position (the fitting completion position) with respect to the fitting part 21 can be determined. Thus, this connector 1 can easily perform checking of a mounted state of the water stop member 44 and can thus keep high quality.

The connector according to the present embodiment includes the terminal locking member mounted on the housing from outside and locking the terminal metal parts inside the housing as they are at the housing completion position at its mounting completion position and locks the terminal locking member as it is at the mounting completion position with respect to the housing using the front holder. Thus, this connector can keep the terminal metal parts at the housing completion position even when a terminal locking body (lance) as seen in conventional ones is not provided inside the housing. That is to say, the connector according to the present embodiment enables a reduction in the entire size along with a reduction in the size of the housing compared with conventional ones and can thus keep the terminal metal parts at the housing completion position while achieving a reduction in the entire size.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal metal part mounted on an end of an electric wire;

a housing housing the terminal metal part at a housing completion position inside the housing and to be inserted and fit into a counterpart fitting portion headed by a tip;

a terminal locking member mounted on the housing from outside along a direction crossing an insertion direction of the housing to the counterpart fitting portion and locking the terminal metal part as the terminal metal part is at the housing completion position at a mounting completion position with respect to the housing; and a front holder causing the housing to be inserted headed by the tip and locking the terminal locking member at the mounting completion position wherein the housing has a fitting part housing the terminal metal part inside the fitting part and to be inserted and fit into the counterpart fitting portion having an inner circumferential wall face and a protruding part at the tip protruding toward the insertion direction side from an end face of the fitting part on the insertion direction side, housing the terminal metal part inside the protruding part, and mounted with the terminal locking member, and the front holder has a first tube part causing the fitting part to be inserted and a second tube part causing the protruding part to be inserted together with the terminal locking member.

2. The connector according to claim 1, further comprising:

a ring-shaped water stop member having an inner circumferential face side fit to a protruding portion of an outer circumferential wall face of the fitting part from the front holder to fill a ring-shaped gap between the protruding portion of the outer circumferential wall face and the inner circumferential wall face of the counterpart fitting portion, wherein the front holder locks the water stop member at a fitting completion position with respect to the fitting part.

3. The connector according to claim 2, wherein the water stop member has a locked part protruding inward from the inner circumferential face, the fitting part has a locking part causing the locked part to be inserted and locking the locked part, and one of the fitting part and the front holder has a viewing window part communicating with the locking part and enabling the locked part inserted into the locking part to be visually checked from outside with the front holder mounted on the fitting part.

* * * * *